United States Patent [19]

Hunter

[11] Patent Number: 4,881,728

[45] Date of Patent: Nov. 21, 1989

[54] ADJUSTABLE HEAD SUPPORT ATTACHMENT FOR THERAPY TABLE

[76] Inventor: Lemna J. Hunter, 2005 MacKinnon Ave., Cardiff, Calif. 92007

[21] Appl. No.: 240,622

[22] Filed: Sep. 6, 1988

[51] Int. Cl.[4] ..... A47C 7/38

[52] U.S. Cl. ..... 269/328

[58] Field of Search ..... 269/322, 323, 328, 324, 269/325; 297/408, 391; 188/82.4, 82.7; 5/434, 437

[56] References Cited

U.S. PATENT DOCUMENTS

| | | | |
|---|---|---|---|
| 2,873,848 | 2/1959 | Steinmetz | 188/82.4 |
| 4,266,760 | 5/1981 | Matsui et al. | 297/408 |
| 4,353,595 | 10/1982 | Kaneko et al. | 297/408 |
| 4,765,683 | 8/1988 | Hattori | 297/408 |
| 4,771,493 | 9/1988 | Park | 269/328 |

FOREIGN PATENT DOCUMENTS

| | | | |
|---|---|---|---|
| 2819202 | 8/1979 | Fed. Rep. of Germany | 269/325 |
| 3536012 | 4/1987 | Fed. Rep. of Germany . | |

*Primary Examiner*—Robert C. Watson

*Attorney, Agent, or Firm*—Baker, Maxham, Jester & Meador

[57] ABSTRACT

An adjustable head support for a therapy table comprises an elongated telescoping shaft having a base on each end thereof for attachment to opposite sides of the apron of a table, a pair of arms secured together in spaced parallel relation and rotatably mounted at one end on the shaft, a generally planar head support member mounted on the outer ends of said arms, a one-way cam brake on one of said arms for stopping rotation thereof relative to said shaft in one direction for selectively holding said head support member in selected support positions, and a brake release for selectively releasing said brake for enabling rotation in said one direction.

11 Claims, 2 Drawing Sheets

ADJUSTABLE HEAD SUPPORT ATTACHMENT FOR THERAPY TABLE

BACKGROUND OF THE INVENTION

The present invention relates to therapy tables and pertains particularly to an adjustable head support attachment.

Therapy tables are widely used by many physicians, and particularly by chiropractors. Many types of such tables exist, including those with adjustable head and leg supports. Adjustable tables are frequently desirable in order to adjust the level of the position of a patient's head, legs or the like relative to the rest of his or her body.

Existing adjustable therapy tables have a number of drawbacks. The chief drawback of existing adjustable tables is the complexity and cost of the adjustable support portion of the table.

Many of the existing tables that are in use today are of the non-adjustable type. It is, therefore, desirable that an adjustable attachment be available for existing non-adjustable tables.

SUMMARY AND OBJECTS OF THE INVENTION

It is the primary object of the present invention to provide an improved adjustable head support for therapy tables.

In accordance with a primary aspect of the present invention, a head support attachment for a therapy table comprises an extensible shaft, including means for attachment to an apron of a table, with arms rotatably mounted to the shaft, a brake assembly for holding the arms from rotating on the shaft, and a head support pad or platform mounted on the outer ends of the arms.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
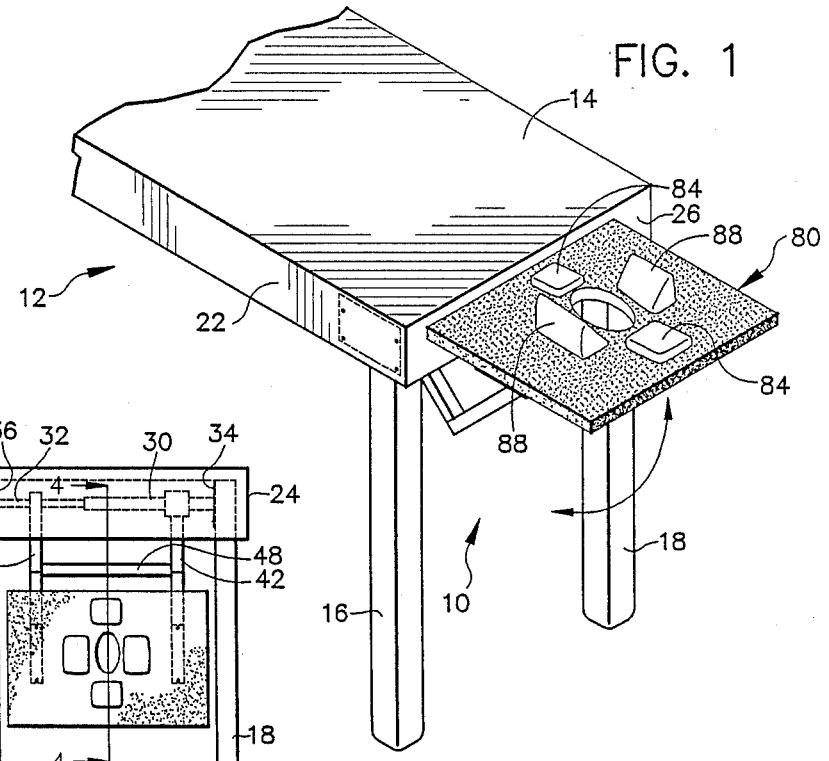
FIG. 1 is a perspective view illustrating a preferred embodiment of the invention in place on the end of a table.

Referring to FIG. 1 of the drawings, there is illustrated a preferred embodiment of the invention, designated generally by the numeral 10, mounted to one end of a conventional therapy table, designated generally by the numeral 12. A somewhat conventional non-adjustable therapy table 12 is illustrated, which comprises a top generally flat planar support surface 14, which typically comprises a generally flat support panel of a rectangular configuration covered by a foam padding and vinyl cover. The top is supported on a plurality of vertically extending support legs (only three of which are shown) 16, 18 and 20. An apron consisting of a pair of side rails or panels 22 and 24, and a pair of end rails or panels 26 and 28, are secured around the top of the leg structure just below the top support panel. This provides bracing for the legs, as well as additional support for the top panel.

The top and sides or apron are typically covered by a foam or like padding and a vinyl or like covering, which are not shown in detail as they form no part of the present invention.

Figure 2:
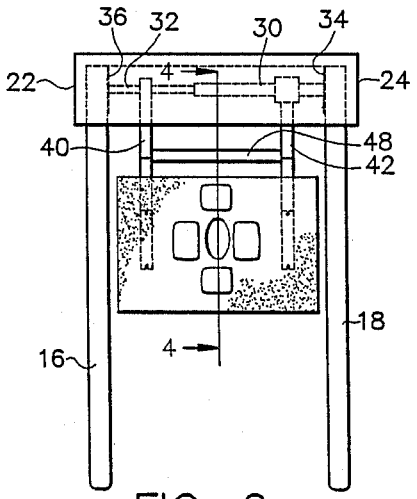
FIG. 2 is an end view of the table showing the head support in the retracted position.
Figure 3:
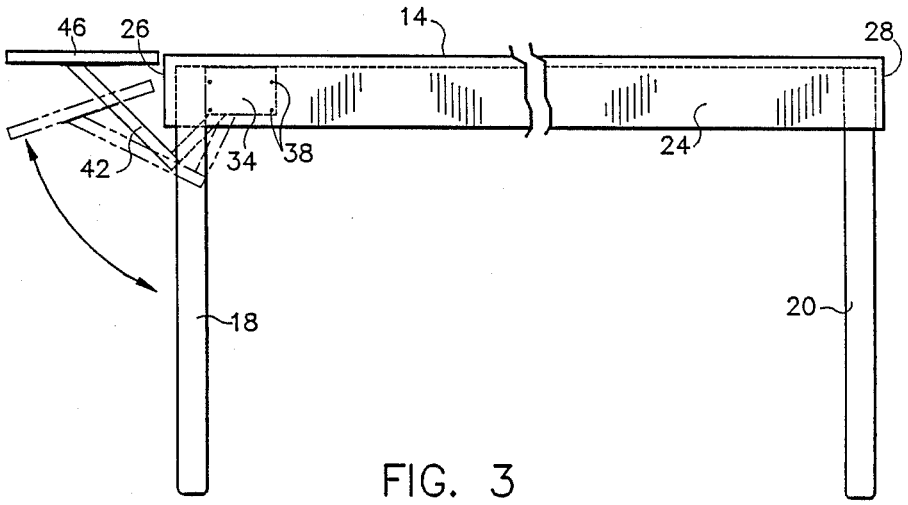
FIG. 3 is a side elevation view of the table showing the head support in the support position.
Figures 4, 5:
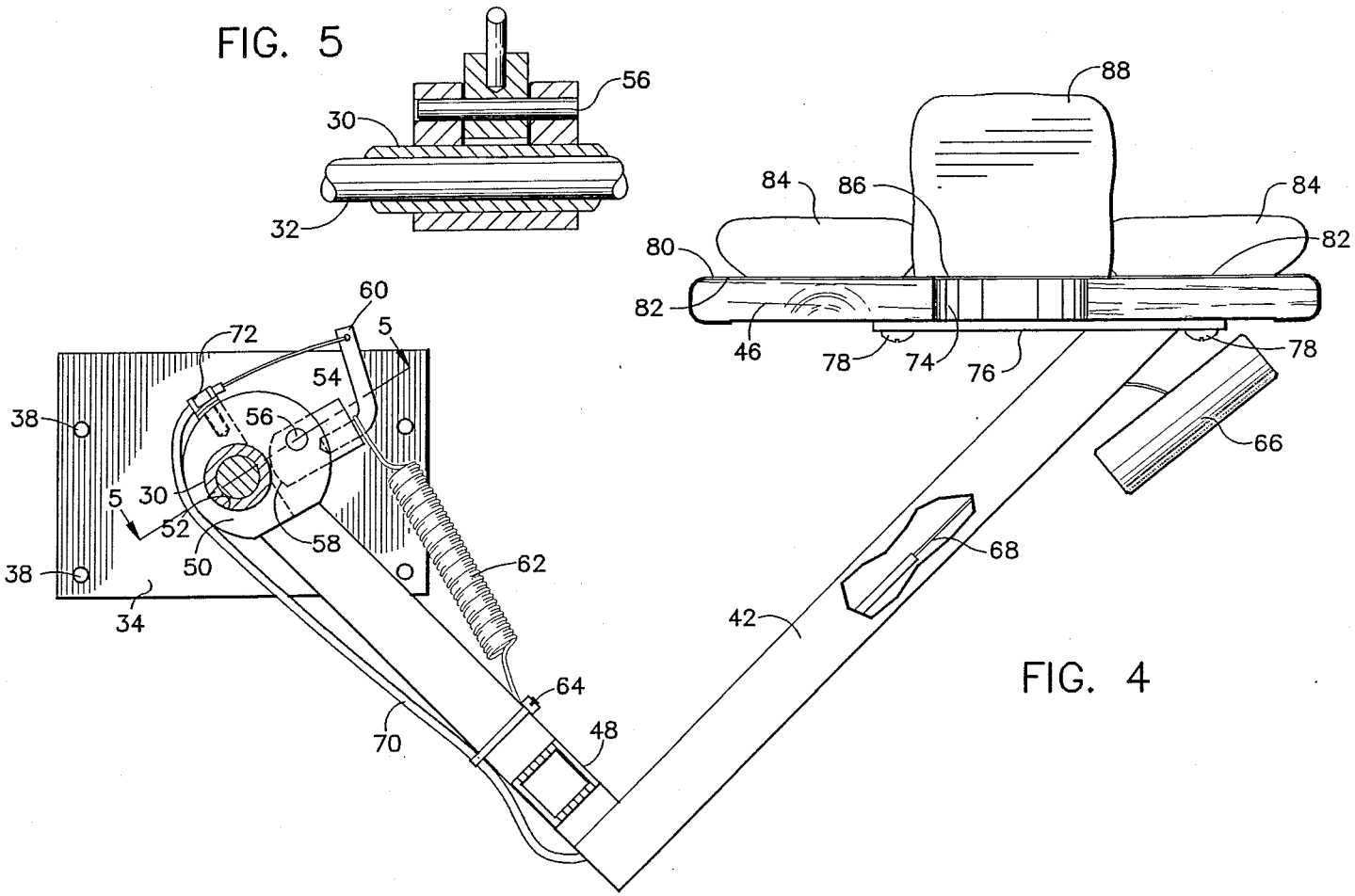
FIG. 4 is a section view taken on line 4—4 of FIG. 2.
FIG. 5 is a detailed section view taken on line 5—5 of FIG. 4.

Referring particularly to FIGS. 2–4, an adjustable head support attachment apparatus is illustrated. The support apparatus comprises an extensible or telescoping shaft, comprising an elongated cylindrical tubular shaft 30, and an elongated cylindrical solid shaft 32 telescopically received within the bore of the shaft 30. Attachment members or plates 34 and 36 are secured such as by welding to the ends of the respective shafts 30 and 32. These are formed as rectangular plates with holes for attachment to the inside surface of the side rail portions 22 and 24 of the table apron.

The telescoping feature of the shaft combination enables the shaft assembly to extend or retract in length to fit different width tables. The mounting plates 34, 36, as illustrated in FIGS. 3 and 4, are each generally rectangular plates formed of stainless steel or the like, and having a plurality of screw or bolt receiving holes 38 for receiving screws or bolts for attachment to the inside of the apron of the table.

A pair of L-shaped arms 40 and 42 are each pivotally or rotatably mounted at one end to the respective portions of the telescoping shaft 30, 32. The arms are each connected at the other end to a support panel or platform 46, which has a generally rectangular configuration and serves as a head support as will be described. The arms are connected together in spaced parallel relation by means of a cross member 48.

The end of arm 40 is journaled on shaft 32 by means of a journal member and a conventional bushing or the like not shown. The arm 42 is journaled by means of a brake assembly, as shown in FIG. 4, which enables infinitesimal adjustments to be made in the positioning of the support platform or panel 46 relative to the table support surface 14.

Referring to FIG. 4, the combination bearing brake assembly comprises a body support member 50 having a bore 52 in which the shaft 30 is journaled, and is connected such as by welding to the end of the L-shaped arm 42. The brake body member 50, as shown in FIG. 5, is formed with a slot in one side thereof in which is pivotally mounted an eccentric brake cam member 54, which is pivotally mounted by means of a shaft 56. The cam member 54 includes an arcuately shaped brake surface 58, which cooperatively engages the surface of shaft 30 for locking the arm in selected positions.

In the illustrated embodiment, the brake cam 54 is eccentrically mounted, such that attempts to move the arm 42 in the clockwise direction forces the surface 58 into tighter engagement with the surface of the shaft 30 for locking the member in position. The brake member 54 is provided with an arm 60 to which is connected a suitable biasing means in the form of an elongated tensioned coil spring 62, which is connected at one end to the arm 60, and at the other end to the arm 42 by suitable bolt or the like 64. Other biasing means may be utilized as desired.

Brake releasing means for releasing the brake comprises a handle 66, disposed beneath the head support table 46, and connected by a bolt and wire cable 68 to the arm 60. The cable 68 includes a central flexible wire member encased within a sheath 70, which is anchored at one end by means of a clamp or the like 72 to the brake body member 50. The sheathed cable 68, 70 extends into and along hollow arm member 42 The handle 66 is conveniently positioned just beneath the support platform 46 for convenient grasping simultaneously therewith for releasing. Thus, positive release of the brake must be accomplished by the positive force on the handle 66 transmitted to the brake cam member 54

The brake cam is constructed and arranged geometrically, such that force or load on the table 46 increases the brake force on the brake member 54. The cam or brake surface 58 has a center of or axis that is offset from and non-aligned with the center of the pivot axis of the member 54, as defined by the axis of shaft 56.

Referring to FIG. 4, the head support panel 46 is formed of a wooden panel with a central opening 74, preferably of a generally elongated or oval configuration, and designed to accommodate a face down position of a patient. A suitable padding and covering, such as foam and vinyl, covers the upper surface of the panel member 46 and is secured to the ends of the arms 40 and 42 by means of bracket members 76, only one of which is shown. These bracket members are secured such as by welding to the outer end of the arms 42, and secured by screws or the like 78 to the underside of the member 46.

An adjustable or modifiable support surface is provided on the top of the head support panel 46. In a preferred form, the head support panel 46 is covered by a covering of a woven type fabric 80 on the upper surface forming a loop type structure, which is engaged by hook type fabric 82 on the bottom of pillows or pads 84 and by hook fabric 86 on the bottom of pillows or pads 88. This arrangement enables the pads, as can be seen in FIG. 1, to be moved around to selected positions on the head support panel or table relative to the opening 74. These support pads can therefore be adjusted toward and away from each other, or in other positions to accommodate differences in size and shapes of heads of patients. The head support table member itself can be adjusted to different height positions relative to the support surface of the table 14, as will be appreciated from FIGS. 1 and 3. Thus, the surface of the support table 46 may be positioned above or below the support surface 14 as may be desired.

While I have illustrated and described my invention by means of specific embodiments, it is to be understood that numerous changes and modifications may be made therein without departing from the spirit and scope of the invention as defined in the appended claims.

I claim:

1. An adjustable head support for a therapy table, comprising:

an elongated telescoping shaft having means one each end thereof for attachment to opposite side rails of tables of different width;

a pair of arms each rotatably mounted at an inner end at spaced positions along said shaft;

a head support member mounted on an outer end of said arms;

a one-way brake on one of said arms for stopping rotation thereof relative to said shaft in one direction, said brake comprises a hub rotatably supporting said arm on said shaft, and an eccentric cam mounted on said hub and biased into engagement with said shaft; and brake release means for selectively releasing said brake for enabling rotation in said one direction, said brake release means comprises an elongated cable connected at one end to said eccentric cam and a handle connected at the other to said cable and positioned beneath said head support member.

2. An adjustable head support according to claim 1, wherein:

said arms are L-shaped.

3. An adjustable head support according to claim 1, wherein:

said head support member comprises a generally rectangular planar support platform.

4. An adjustable head support according to claim 1, wherein:

said arms are L-shaped; and said head support member comprises a generally rectangular planar support platform.

5. An adjustable head support according to claim 1, wherein:

said head support member comprises a generally rectangular planar support platform having an opening substantially in the center thereof;

a plurality of support pads for selectively positioning on said platform; and means for detachably securing said pads in selected positions on said platform.

6. An adjustable head support for a therapy table, comprising:

an elongated telescoping shaft having means on each end thereof for attachment to opposite sides of the apron of a table;

a pair of arms secured together in spaced parallel relation and rotatably mounted at one end at spaced positions along said shaft;

a generally planar head support member mounted on the outer ends of said arms;

a one-way cam brake on one of said arms for stopping rotation thereof relative to said shaft in one direction for selectively holding said head support member in selected support positions, said brake comprises a hub rotatably supporting said arm on said shaft, and an eccentric cam mounted on said hub and biased into engagement with said shaft; and brake release means for selectively releasing said brake for enabling rotation in said one direction, said brake release means comprises an elongated cable connected at one end to said eccentric cam and at the other to a handle beneath said head support member.

7. An adjustable head support according to claim 6, wherein:

said arms are L-shaped and formed of square tubes.

8. An adjustable head support according to claim 7, wherein:

said head support member comprises a generally rectangular planar support platform having an opening substantially in the center thereof;

a plurality of support pads for selectively positioning on said platform; and means for detachably securing said pads in selected positions on said platform.

9. A combination of an elongated planar therapy table of the type having an elongated planar support surface with an apron depending downward therefrom and supported on a plurality of vertically extending legs, and adjustable head support attachment thereon, comprising:

an elongated telescoping shaft having means on each end thereof for attachment to opposite sides of the apron of said table;

a pair of arms secured together in spaced parallel relation and rotatably mounted at one end at spaced positions along said shaft;

a generally planar head support member mounted on the outer ends of said arms;

a one-way cam brake on one of said arms for stopping rotation thereof relative to said shaft in one direction for selectively holding said head support member selected support positions, said brake comprises a hub rotatably supporting said arm on said shaft, and an eccentric cam mounted on said hub and biased into engagement with said shaft; and brake release means for selectively releasing said brake for enabling rotation in said one direction, said brake release means comprises an elongated cable connected at one end to said eccentric cam and at the other to a handle beneath said head support member.

10. An adjustable head support according to claim 9, wherein:

said arms are L-shaped and formed of square tubes.

11. An adjustable head support according to claim 9, wherein:

said head support member comprises a generally rectangular planar support platform having an opening substantially in the center thereof;

a plurality of support pads for selectively positioning on said platform; and means for detachably securing said pads in selected positions on said platform.

* * * * *